US011351573B2

(12) United States Patent
Cappozzo

(10) Patent No.: US 11,351,573 B2
(45) Date of Patent: Jun. 7, 2022

(54) DISC SCREEN FOR SEPARATING SOLID MATERIALS

(71) Applicant: ECOSTARGREEN S.R.L., Sandrigo (IT)

(72) Inventor: Domenico Cappozzo, Sandrigo (IT)

(73) Assignee: ECOSTARGREEN S.R.L., Sandrigo (IT)

( * ) Notice: Subject to any disclaimer, the term of this patent is extended or adjusted under 35 U.S.C. 154(b) by 0 days.

(21) Appl. No.: 16/945,997

(22) Filed: Aug. 3, 2020

(65) Prior Publication Data

US 2021/0031237 A1 Feb. 4, 2021

(30) Foreign Application Priority Data

Aug. 2, 2019 (IT) ..... 102019000013791

(51) Int. Cl.
*B07B 1/15* (2006.01)
*B07B 1/42* (2006.01)

(52) U.S. Cl.
CPC . *B07B 1/15* (2013.01); *B07B 1/42* (2013.01)

(58) Field of Classification Search
CPC .. B07B 1/14; B07B 1/15; B07B 1/155; B07B 1/42; B07B 1/46; B07B 1/4609
USPC ..... 209/261
See application file for complete search history.

(56) References Cited

U.S. PATENT DOCUMENTS 3,870,627 A 3/1975 Herkes
4,037,723 A * 7/1977 Wahl ..... B07B 1/15 209/672
4,972,959 A * 11/1990 Bielagus ..... D21B 1/023 209/672
5,740,922 A * 4/1998 Williams ..... B07B 1/4636 209/672
8,336,714 B2 * 12/2012 Campbell ..... B07B 4/08 209/11
8,360,249 B1 * 1/2013 Currey ..... B02C 23/16 209/672
8,424,684 B2 * 4/2013 Campbell ..... B07B 1/4627 209/672
8,627,962 B2 * 1/2014 Cappozzo ..... B07B 1/44 209/672
8,646,615 B2 * 2/2014 Bruggencate ..... B07B 1/4618 209/672
8,800,781 B1 * 8/2014 Carlile, Jr ..... B07B 1/155 403/204

(Continued)

FOREIGN PATENT DOCUMENTS

CN 207343212 U * 5/2018
CN 109078826 A * 12/2018

(Continued)

*Primary Examiner* — Gene O Crawford
*Assistant Examiner* — Muhammad Awais
(74) *Attorney, Agent, or Firm* — Mark M. Friedman

(57) ABSTRACT

A disc screen for separating solid residues which comprises multiple parallel rotation shafts, each of which carrying, fixed thereto, a plurality of discs. The lateral faces of the aforesaid discs are provided with thrust wings having curved section, which are adapted to intercept components of the material to be screened, in particular light or filamentous materials, in order to expel them outside the interspaces between the discs, so as to prevent possible tangling and obstruction of such materials at the rotation shafts.

12 Claims, 11 Drawing Sheets

(56) References Cited

U.S. PATENT DOCUMENTS

| | | | | |
|---|---|---|---|---|
| 9,636,711 | B2 * | 5/2017 | Benjamins | B07B 1/15 |
| 10,111,385 | B2 * | 10/2018 | DeMont | B07B 1/46 |
| 2003/0183561 | A1 * | 10/2003 | Smook | B07B 1/15 209/672 |
| 2004/0069693 | A1 * | 4/2004 | Paladin | D21B 1/023 209/672 |
| 2006/0226054 | A1 * | 10/2006 | Bishop | B07B 1/4618 209/667 |
| 2010/0219111 | A1 * | 9/2010 | Brasseur | B07B 1/15 209/672 |
| 2016/0318070 | A1 * | 11/2016 | Davis | B07B 1/155 |
| 2017/0304868 | A1 * | 10/2017 | Parr | D21D 5/046 |
| 2017/0368576 | A1 * | 12/2017 | Klaassen | B07B 1/155 |
| 2018/0178253 | A1 * | 6/2018 | Tuttle | B07B 1/155 |

FOREIGN PATENT DOCUMENTS

| | | | | |
|---|---|---|---|---|
| DE | 10027909 | A1 * | 5/2001 | B07B 1/155 |
| DE | 102006017138 | A1 * | 11/2007 | B07B 1/15 |
| DE | 102007027846 | B3 * | 5/2008 | B07B 1/15 |
| DE | 202009012296 | U1 | 1/2011 | |
| DE | 202009012296 | U1 * | 2/2011 | B07B 1/15 |
| DE | 202012006328 | U1 * | 8/2012 | B07B 1/005 |
| DE | 102013018467 | A1 * | 5/2015 | B07B 1/15 |
| DE | 102011123053 | B3 * | 3/2017 | B07B 1/15 |
| EP | 1106264 | A2 | 6/2001 | |
| EP | 3085462 | A1 | 10/2016 | |
| EP | 3085462 | A1 * | 10/2016 | B07B 1/15 |
| GB | 2072049 | A * | 9/1981 | A01D 17/06 |
| GB | 2072049 | A | 9/1981 | |
| WO | WO-2017080893 | A1 * | 5/2017 | B07B 1/15 |
| WO | WO-2017081365 | A1 * | 5/2017 | A01D 17/06 |

* cited by examiner

DISC SCREEN FOR SEPARATING SOLID MATERIALS

FIELD OF APPLICATION

The present invention regards a disc screen for separating solid materials.

The present disc screen is intended to be employed, in a per se conventional manner, for separating solid materials of various type, such as: solid urban waste, inert fluvial material, products of the organic fractions of separate waste collection, compost (for the refining thereof), recycled wood, biomass, inert material, demolition material, land drainage material and dump material, glass, plastic, scrap metal and still other materials.

The disc screen according to the invention is therefore inserted in the industrial field of treating solid residues and is advantageously intended to be installed downstream of the crushing or grinding plants for the same residues.

State of the Art

Hereinbelow, with the term "residues", any one solid material that requires being separated into its components based on the dimensions or on the mass will indiscriminately indicated, and for the sake of description brevity.

Known on the market are numerous different apparatuses intended to be employed for separating solid residues in multiple application fields, which employ different structural and operational principles. Several examples of such apparatuses comprise: disc screens, mesh screens, screw screens, drum screens, ballistic separators, fluid bed separators, electrostatic separators, magnetic separators and still other apparatuses.

In particular, the disc screens usually comprise a support structure which rotatably carries, mounted thereon, numerous shafts equidistant in succession, parallel to each other and rotating in a same rotation sense. Axially fixed on each shaft is a group of discs separated from each other by a distance at least equal to, preferably greater than, the thickness of the single discs in order to allow interposing the mounted discs on the contiguous shafts, such that each disc of any one shaft is interposed between two discs of the adjacent front and rear shafts.

In the present field of the art, one measuring item which distinguishes the characteristics of the disc screen is the screening surface. The latter is defined as the area of the openings delimited between the discs and the rotation shafts and is therefore indicative of the sizing of the residues which are separated from the screen, falling via gravity below the screening surface.

Known from the patent EP 1106264 is a disc screen provided with idle sleeves mounted around each shaft and interposed between the discs, having the function of preventing or at least limiting the obstruction of the screening surface.

More in detail, each sleeve is axially mounted on the shaft between two discs with the clearance adapted to allow it to freely rotate in an idle manner on the shaft or on a tubular body provided outside the shaft.

In operation, possible filiform elements, which are externally twisted around the idle sleeves up to affecting the discs mounted on the contiguous shafts, would not compromise the operation of the screen nor could they determine the stoppage thereof since each sleeve, being idle with respect to the shaft on which it is mounted, would not obstruct the rotation of the shaft itself.

The main drawback of this solution lies in the fact that the disc screens with idle sleeves of known type allow small-size material, such as sand, dust, etc., to be inserted in the clearance existing between the idle sleeves and the discs fit on the shafts, so as to create a mechanical connection between the rotation shafts and the sleeves themselves, coming to drive in rotation the sleeves, to the detriment of their anti-twisting action.

In order to overcome such drawbacks, known from patent application EP 3085462 is a screen of the above-described type in which the idle sleeves are provided with two flanges intended to be inserted in a suitable trough made on the lateral faces of the discs so as to prevent such deposits of material and to create in any case a clearance between sleeves and discs such to allow the sleeve to idly rotate with respect to the disc and preventing problems with twisting. However, also this type of screens has several drawbacks including the low efficiency in separating plastic materials of different sizing, and in particular of the plastic materials for shopper bags, packages, bags, etc.

More in detail, several types of plastic material (e.g. the aforesaid materials for shopper bags, packages, bags) but also any flexible sheet-like plastic material, could be fitted between the discs of the screen and generate problems in the operation of the screen and also increase the times and costs of maintenance.

Also known from documents GB 2072049 and U.S. Pat. No. 3,870,627 are disc screens provided with so-called "star" discs, provided on their external section with one or more projecting tips. In particular, the screen described in GB 2072049 provides that some discs are provided, along the external edge, with a projecting tip thereof, with an enlarged area in order to prevent the penetration of rocks or other objects between the discs.

The disc screens for separating solid materials known in the art have therefore demonstrated that they do not lack drawbacks. Among these, there is the low capacity to direct the aforesaid types of residues towards the advancing direction; in this manner, such residues can be undesirably screened or they can easily be inserted between the discs or they can be twisted around the discs and the rotation shafts, causing the stoppage of the screen for a manual removal thereof.

Presentation of the Invention

In this situation, the problem underlying the present invention is therefore that of eliminating the problems of the abovementioned prior art, by providing a disc screen for separating solid materials which allows eliminating or significantly reducing the drawbacks due to the twisting of filiform elements around the discs and the rotation shafts, in particular preventing repeated maintenance operations.

A further object of the present invention is to provide a disc screen for separating solid materials, which has a high efficiency of separation between plastic materials having different sizing.

A further object of the present invention is to provide a disc screen for separating solid materials, which is entirely reliable in operation over time.

A further object of the present invention is to provide a disc screen for separating solid materials, which is inexpensive to make.

BRIEF DESCRIPTION OF THE DRAWINGS

The technical characteristics of the finding, according to the aforesaid objects, and the advantages thereof, will be more evident in the following detailed description, made with reference to the enclosed drawings, which represent several merely exemplifying and non-limiting embodiments of the invention, in which.

DETAILED DESCRIPTION OF A PREFERRED EMBODIMENT

Figure 1:
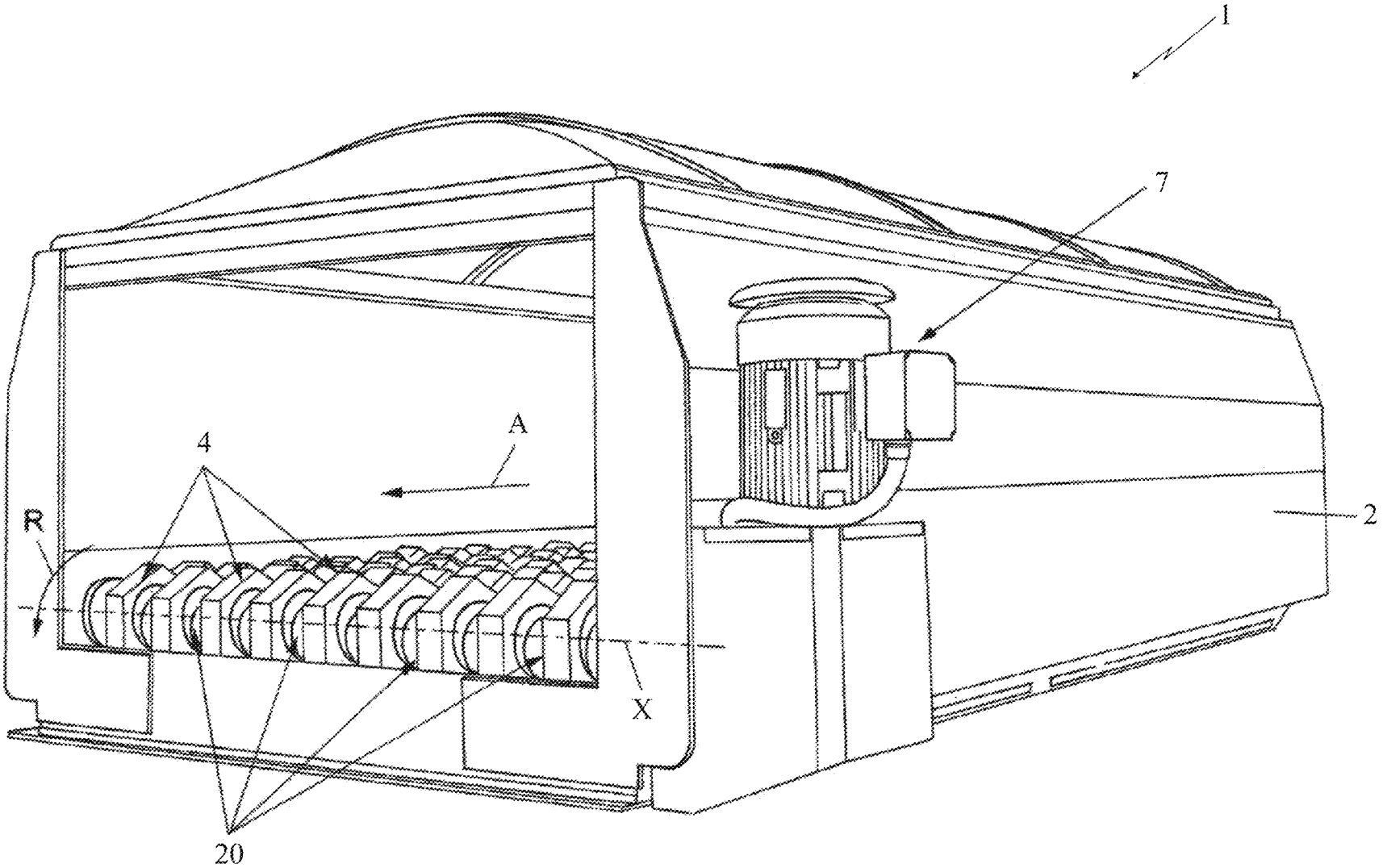
FIG. 1 shows a perspective schematic view of the disc screen for separating solid materials, according to the present invention.

With reference to the enclosed drawings, reference number 1 overall indicates a disc screen for separating solid materials, object of the present invention.

The disc screen 1 according to the present invention is adapted to be employed for separating solid materials of various type such as: solid urban waste, inert fluvial material, products of the organic fractions of the separate waste collection, compost (for the refining thereof), recycled wood, biomass, inert material, demolition material, land drainage material and dump material, glass, plastic, scrap metal and still other materials.

In particular the present disc screen 1 is particularly suitable for separating plastic waste from the remaining solid material mass.

In accordance with the embodiments illustrated in the enclosed figures, the present disc screen 1 comprises a support structure 2, intended to be abutted against the ground, and extended between an inlet door and an outlet door, according to an advancing direction A along which the solid materials to be screened are susceptible to proceed.

The disc screen 1 also comprises a plurality of rotation shafts 3, which are rotatably mounted on the support structure 2 that are parallel to each other, and are arranged in succession along the advancing direction A, spaced one from the next, in particular with constant spacing pitch.

Advantageously, each of the rotation shafts 3 is longitudinally extended according to an extension axis X thereof, preferably horizontal and orthogonal to the advancing direction A. In particular, the extension axes X of the rotation shafts 3 identify a screening surface, preferably horizontal in accordance with the embodiments illustrated in the enclosed figures, but which can also take on a tilt, without departing from the protective scope of the present patent.

According to the present invention, the disc screen 1 also comprises a plurality of discs 4, which are axially fixed in succession along the rotation shafts 3 in order to receive a rotational motion from the latter.

More in detail, each rotation shaft 3 carries, fixed thereto (and preferably fitted), multiple corresponding discs 4 (e.g. nine or ten) arranged in succession along the extension axis X of the rotation shaft 3 itself.

The discs 4 are positioned along the corresponding rotation shaft 3 spaced one from the next, preferably with constant pitch. Advantageously, each disc 4 is provided with a rotation axis Y thereof parallel to the extension axis X of the corresponding rotation shaft 3 and, preferably, coinciding with such extension axis X.

Figure 2:
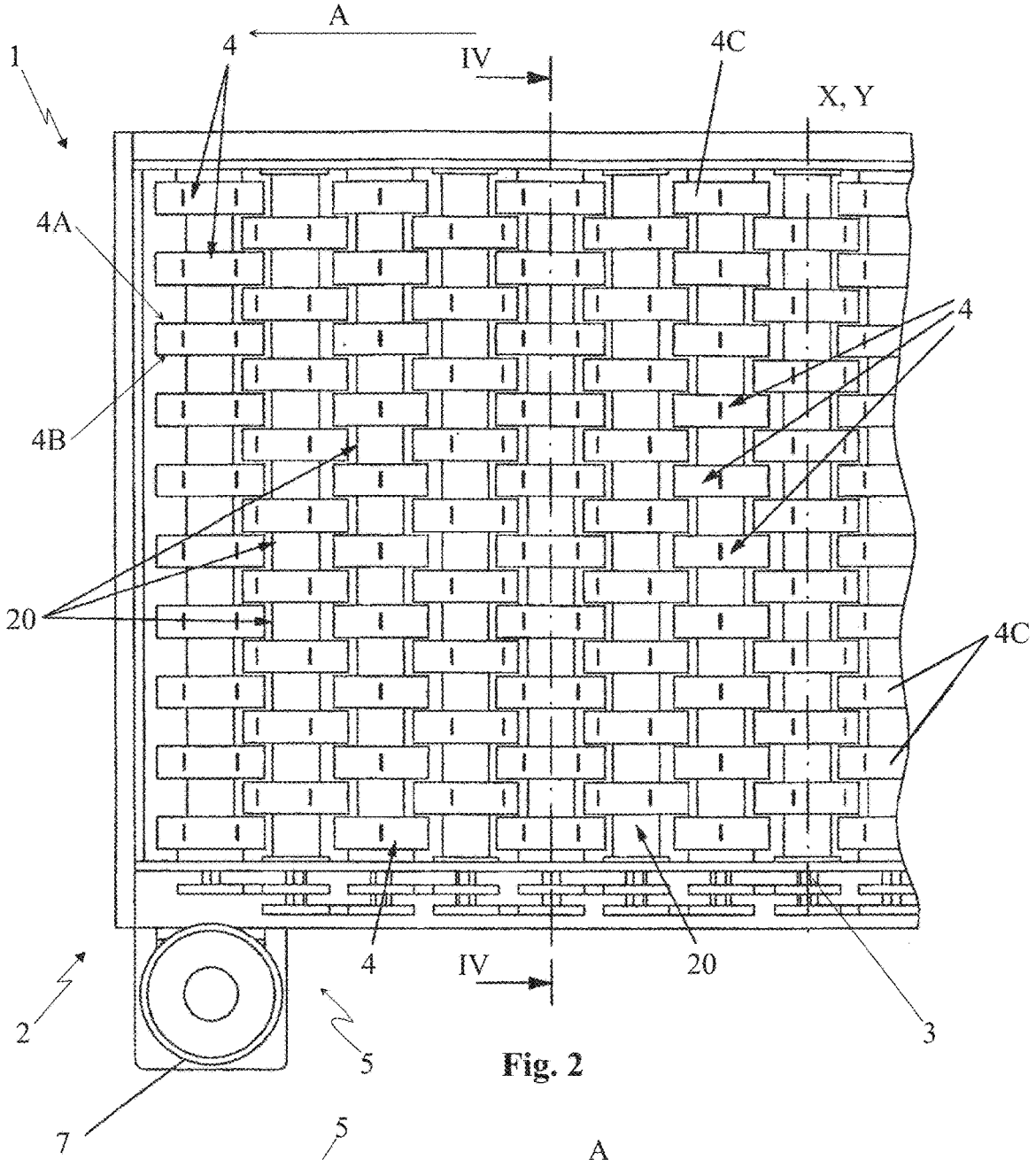
FIG. 2 shows an enlarged detail of the disc screen of FIG. 1 in a plan view, relative to several rotation shafts with a plurality of discs mounted thereon.
Figure 11:
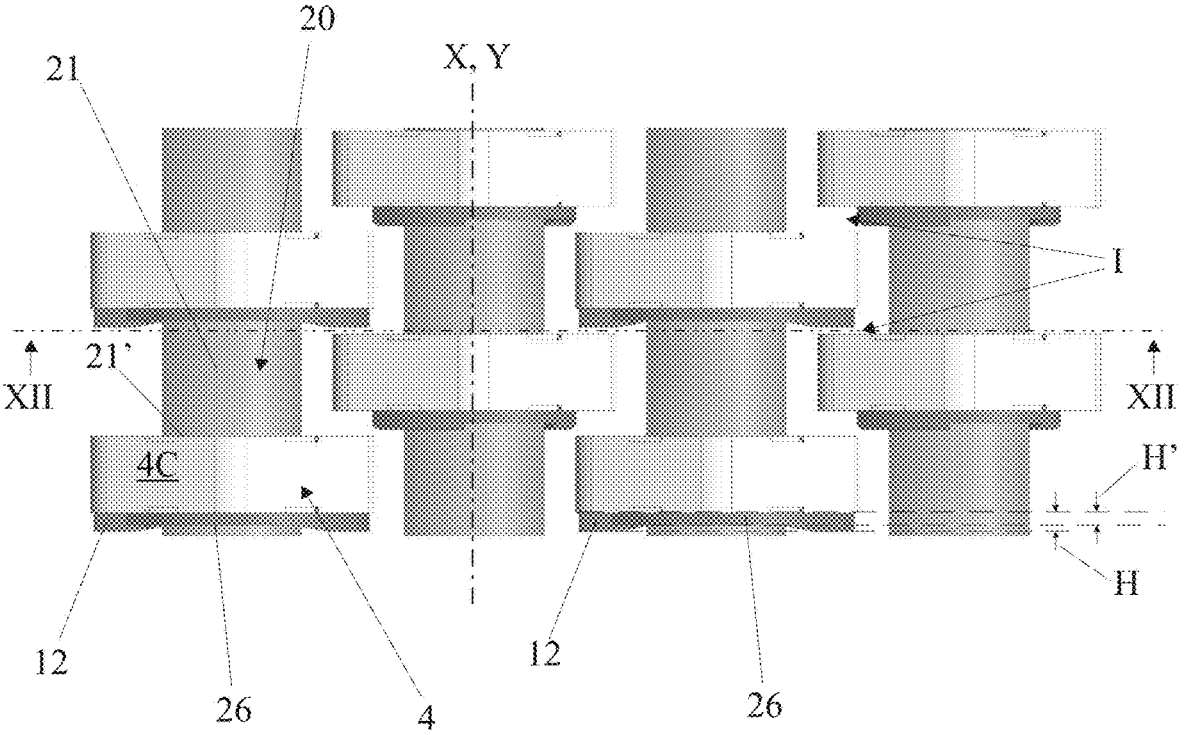
FIG. 11 shows a plan view of part of the rotation shafts of FIG. 10.
Figure 12:
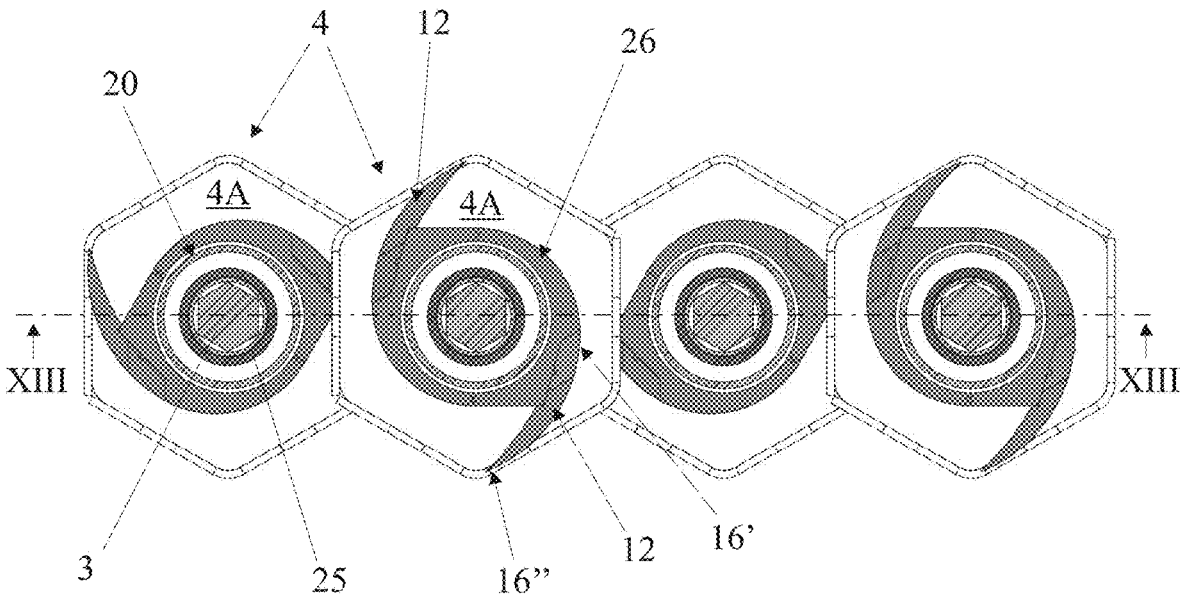
FIG. 12 shows a section view of the rotation shafts of FIG. 11, according to the trace XII-XII of FIG. 11 itself.
Figure 13:
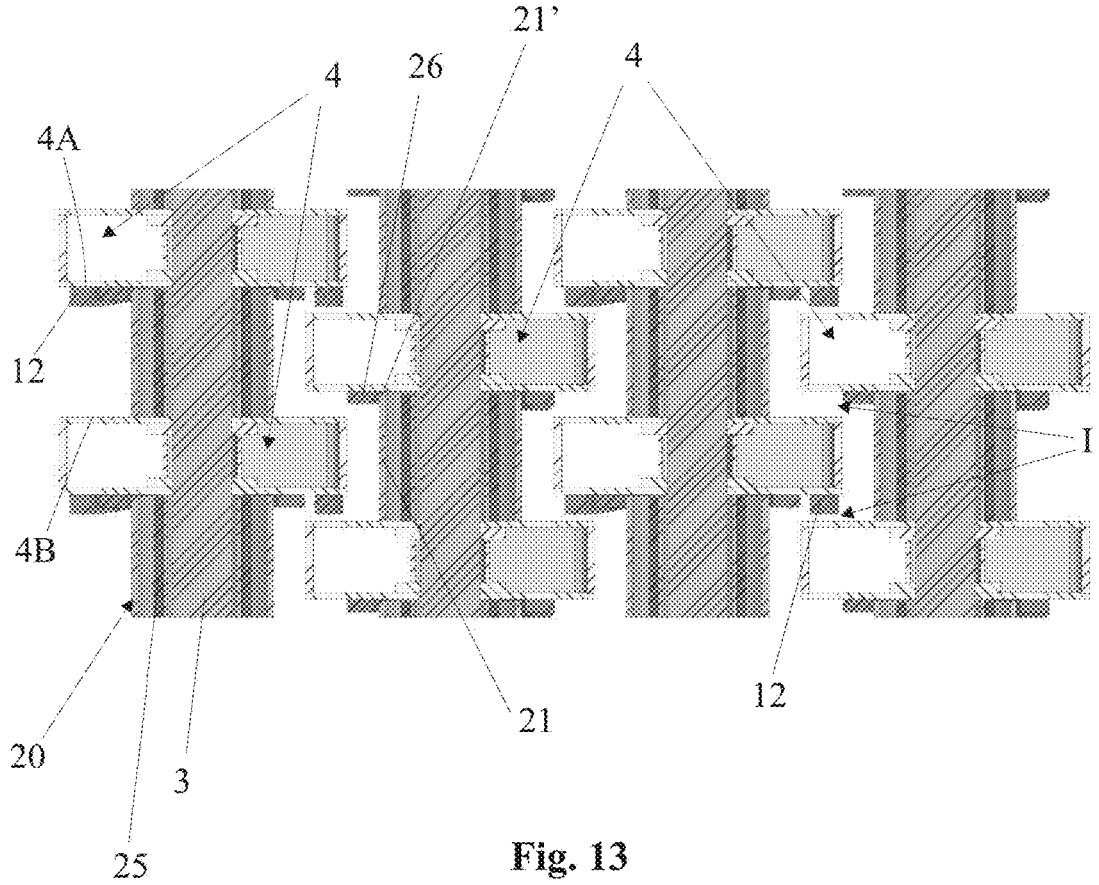
FIG. 13 shows a further section view of the rotation shafts of FIG. 11, according to the trace XIII-XIII of FIG. 12.
Figure 16:
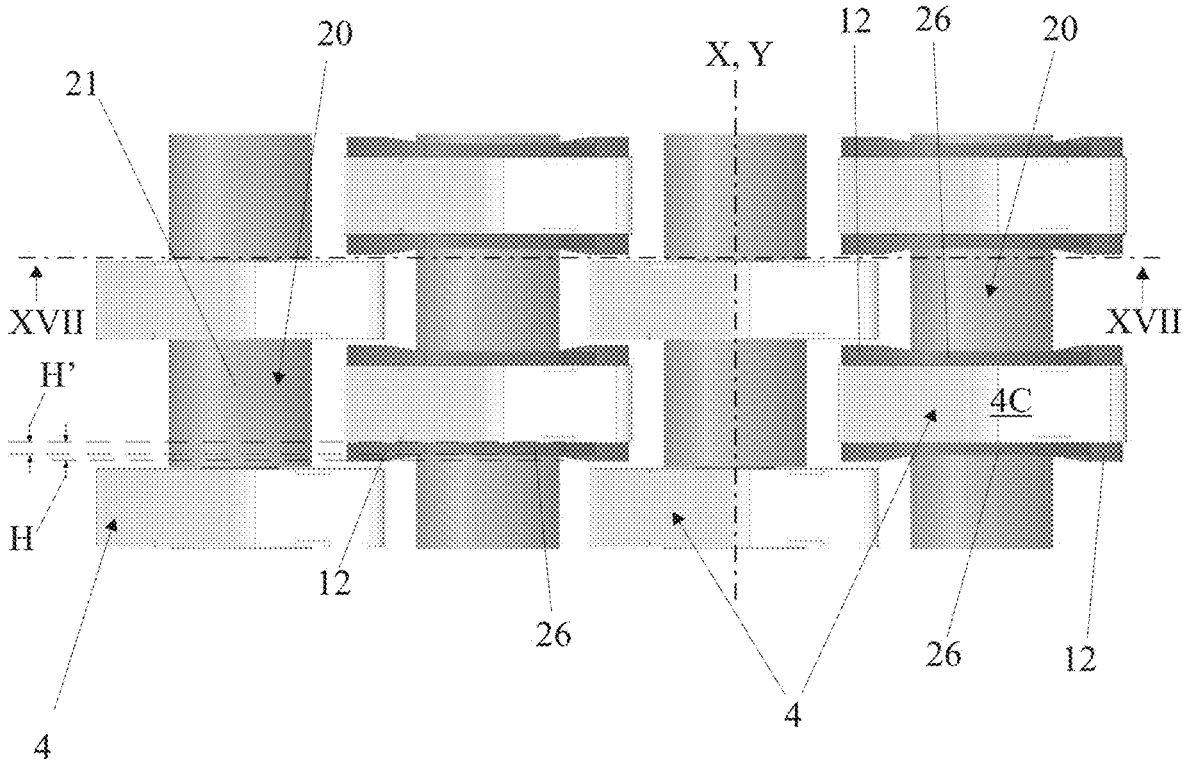
FIG. 16 shows a plan view of a part of the rotation shafts of FIG. 15.
Figure 17:
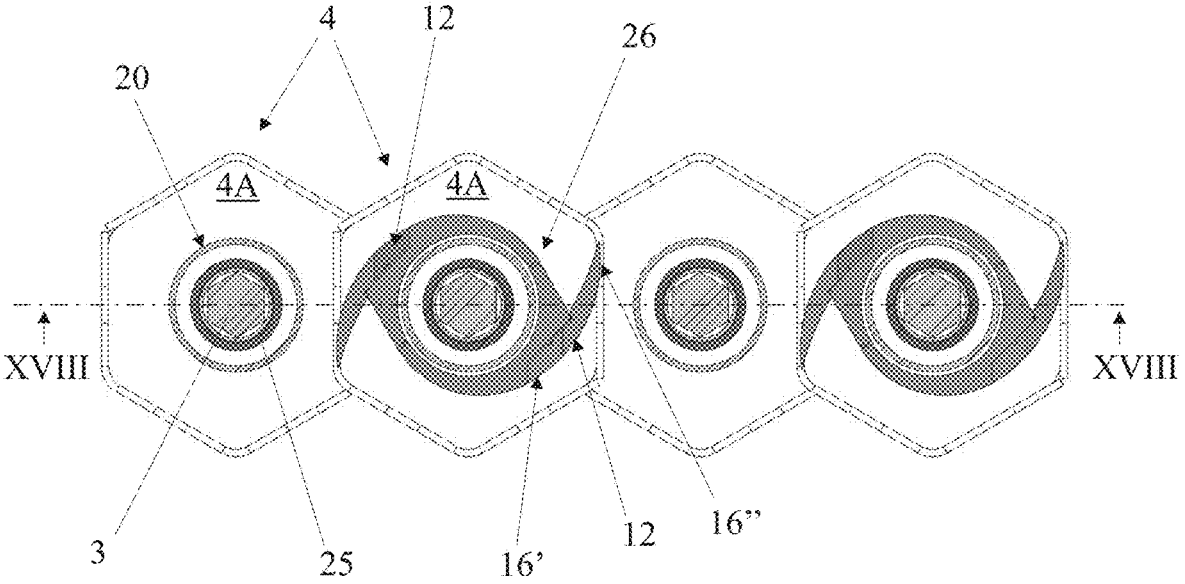
FIG. 17 shows a section view of the rotation shafts of FIG. 16, according to the trace XVII-XVII of FIG. 16 itself.
Figure 18:
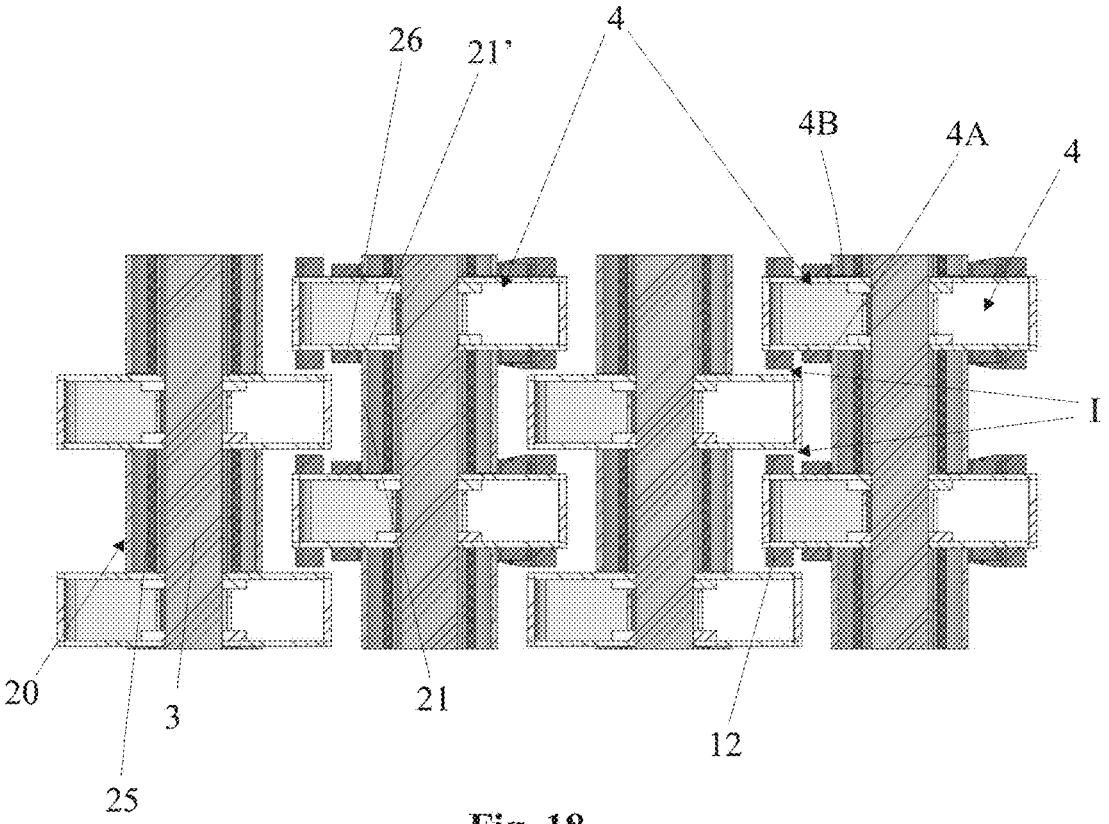
FIG. 18 shows a further section view of the rotation shafts of FIG. 16, according to the trace XVIII-XVIII of FIG. 17.

In particular, as is visible for example in the views of FIGS. 2, 11 and 16, the distance between each disc 4 and the next is greater than the thickness (according to the extension axis X) of each single disc 4, in order to allow interposing between two adjacent discs 4, mounted on the same rotation shaft 3, a disc 4 mounted on the successive rotation shaft 3 according to the advancing direction A, and simultaneously leaving a lateral interspace I between each of the two discs 4 of the rotation shaft 3 and the interposed disc 4 of the successive rotation shaft 3.

For such purpose, the discs 4 mounted on each rotation shaft 3 are mounted offset with respect to the discs 4 mounted on the successive rotation shaft 3, such that they can be interposed therebetween.

In particular, the distance between the rotation shafts 3 along the advancing direction A and the distance between the discs 4 along the rotation axis Y (and in particular the aforesaid lateral interspace I) define the screening section of the disc screen 1, which determines the maximum sizing (dimension) of the materials that are sifted (passing below the rotation shafts 3), while the larger-size materials are conveyed towards the outlet door of the disc screen 1.

Figure 3:
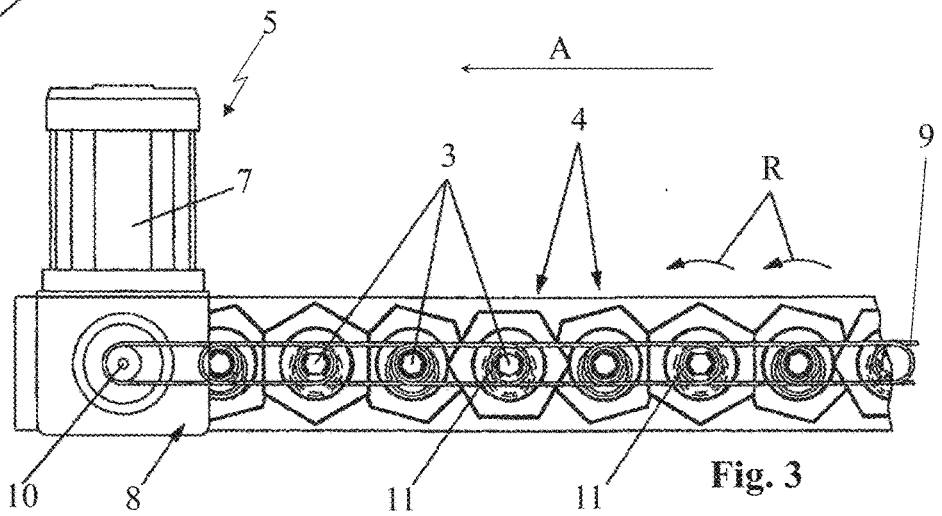
FIG. 3 shows the detail of FIG. 2 in a side view.
Figure 5:
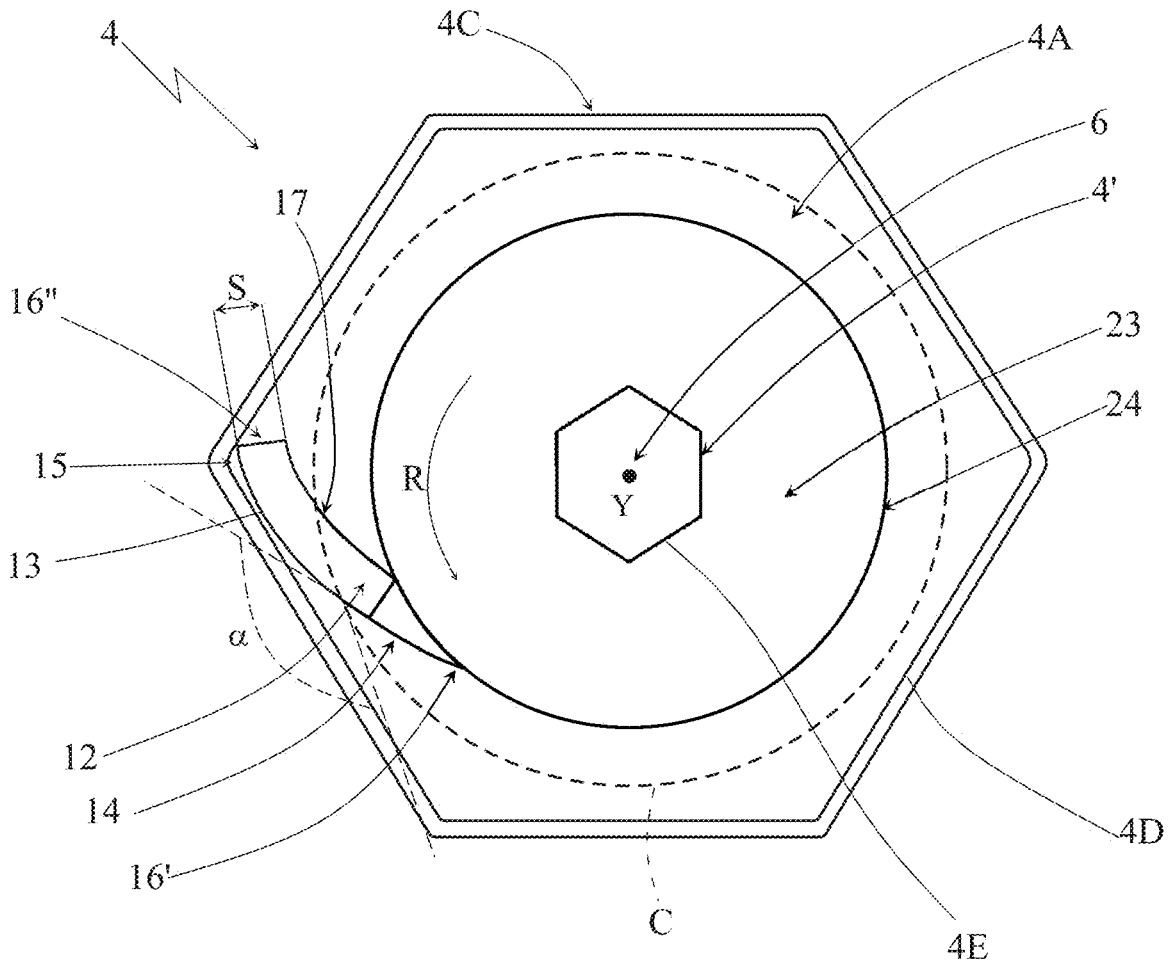
FIG. 5 shows a side view of one of the discs of the screen, in accordance with the aforesaid first embodiment of the present invention.

According to the invention, the disc screen 1 comprises a drive system 5 mechanically connected to the rotation shafts 3 in order to actuate each disc 4 to rotate around the rotation axis Y thereof in a specific rotation sense R (represented for example in FIGS. 1, 3 and 5).

More in detail, the drive system 5 is arranged in order to rotate each rotation shaft 3 around the extension axis X thereof in the aforesaid rotation sense R, in a manner such that each rotation shaft 3 carries in rotation discs 4, mounted thereon.

For such purpose, in particular, the discs 4 are mechanically rigidly coupled to the corresponding rotation shaft 3 in order to receive the rotation motion thereof.

For example, the rotation shaft 3 has a shaped male profile 3', in particular polygonal (defined by the shape of its external surface and in particular by the cross section thereof), and each disc 4 has a shaped female profile 4' joined to the aforesaid shaped male profile 3', and in particular defined by a through hole 6 adapted to receive the rotation shaft 3.

In particular, the rotation of the discs 4 in the aforesaid rotation sense R is such to determine an advancing sense of the residue material along the advancing direction A from the inlet door to the outlet door of the support structure 2 of the disc screen 1, in a manner per se entirely conventional and for this reason not described in more detail.

For example, with reference to the particular embodiment illustrated in FIGS. 2 and 3, the drive system 5 comprises an electric motor 7 and motion transmission 8 mechanically connected to the electric motor 7. Preferably such motion transmission 8 in turn comprises a chain 9 wound as a closed loop and being engaged with a pinion 10 fixed to the shaft of the electric motor 7 and to toothed wheels 11 fitted on each rotation shaft 3.

The drive system 5 is adapted to move all the rotation shafts 3 in the same rotation sense R in order to move, as stated above, the solid material to be screened, accompanied by the rotation of the discs 4, from the inlet door to the outlet door of the disc screen 1.

In particular, the discs 4 are provided with an external section, e.g. polygonal, which, as better described hereinbelow, is suitably shaped so as to facilitate the advancement of the solid material along the screening surface, along the advancing direction A.

With reference to FIGS. 4-18, each disc 4 is extended (according to the rotation axis Y) between two opposite external lateral faces 4A and 4B, which delimit between them the thickness of the disc 4 itself.

In particular, the two lateral faces 4A, 4B of each disc 4 are substantially orthogonal to the rotation axis Y, preferably parallel to each other, and are directed (towards the exterior of the disc 4) in opposite senses with respect to each other.

Advantageously, each lateral face 4A, 4B is provided with an external edge 4D which is extended around the rotation axis Y and delimits such lateral face 4A, 4B, enclosing it at the interior thereof. Preferably, the external edge 4D has convex shape, e.g. polygonal. Advantageously, each lateral face 4A, 4B is provided with an internal edge 4E placed within the external edge 4D and in particular defining the through hole 6 in which the rotation shaft 3 is inserted.

Advantageously, in accordance with the embodiments illustrated in the enclosed figures, each disc 4 is provided with a peripheral surface 4C placed to connect the external edges 4D of the two lateral faces 4A, 4B, and preferably provided with multiple flat faces in a manner such that the disc 4 has the shape of a polygonal prism, e.g. with hexagonal base. Such shape of the disc 4 (and in particular of its peripheral surface 4C) facilitates the advancing of the solid material to be screened during the rotation of the rotation shafts 3. In other embodiments of the present invention, the discs 4 can also have external sections with different shape advantageously adapted to facilitate the advancing of the residues from the inlet door to the outlet door along the advancing direction A. Suitably, each disc 4 is formed by multiple metallic walls joined together and positioned so as to define the aforesaid faces/surfaces 4A, 4B, 4C of the disc 4 itself.

Advantageously, as is visible in the examples of FIGS. 2-4 and 11-18, the present disc screen 1 comprises a plurality of sleeves 20 interposed between pairs of successive discs 4 (along the extension axis X of the corresponding rotation shaft 3) and externally and idly mounted on the rotation shaft 3.

In particular, each sleeve 20 comprises a tubular body 21 extended (according to the extension axis X of the corresponding rotation shaft 3) between two opposite end edges 21', placed at the corresponding lateral faces 4A, 4B of the two discs 4, between which the sleeve 20 is interposed.

Suitably, the screening section of the disc screen 1 is defined by the aforesaid lateral interspaces I and the distance between the peripheral surface 4C of the discs 4 of each rotation shaft 3 and the tubular body 21 of the sleeves 20 of the adjacent rotation shafts 3.

The disc screen 1 preferably comprises a plurality of spacer tubular bodies 25 each of which externally mounted on the rotation shaft 3 and interposed and abutted between the lateral faces 4A, 4B of two discs 4 in succession. In this manner, in particular, the discs 4 are placed in succession along the rotation shaft 3 alternated with the spacer tubular bodies 25 which, pressed between the contiguous discs 4, rotate together with the latter.

Suitably, the spacer tubular bodies 25 have length slightly greater than that of the sleeves 20 in order to allow the idle rotation of the latter.

According to the idea underlying the present invention, the disc 4 comprises at least one thrust wing 12, which is fixed to a corresponding face of the lateral faces 4A, 4B of the disc 4 itself.

As reported in the examples set forth below, it can be provided to apply one or more thrust wings 12 on one or both lateral faces 4A, 4B of the discs 4. In addition, the thrust wings 12 can suitably be prearranged on all the discs 4 of the screen 1 or only in some subsets of the discs 4 (e.g. on the discs 4 of only some of the rotation shafts 3). As discussed in detail hereinbelow, the aforesaid thrust wings 12 according to the invention are adapted to intercept a component of the solid material (in particular components of light material, such as filamentous plastic components) which penetrates between the lateral interspaces I of the discs 4 and, following the rotation of the corresponding discs 4, to push such component out of the lateral interspaces I, in particular pushing the material in the advancing direction A towards the outlet door of the disc screen 1, in a manner such to prevent possible obstructions or tangling susceptible of obstructing the correct operation of the disc screen 1.

Suitably, following the rotation of the corresponding discs 4, the thrust wings 12 are susceptible of generating a centrifugal air vortex which assists in maintaining the component of light materials lifted from the rotation shafts 3, further reducing the risk of obstructions or tangling.

In particular, the claimed arrangement of the thrust wings 12 allows opposing the drawbacks shown by the prior art, by preventing residues with sizing different from that to be screened and filamentous residues, which could be potentially twisted around the rotation shafts 3, from being moved away from the lateral interspaces I between the discs 4 and made to proceed in the advancing direction A, thus decreasing the maintenance required by the disc screen 1 and increasing the screening efficiency.

More in detail, with reference to the examples of FIGS. 5-18, the thrust wing 12 is extended (in the direction of the rotation axis Y) projectingly from the corresponding lateral face 4A, 4B, extended in the lateral interspace I between the lateral face 4A, 4B and the disc 4 facing such lateral face 4A, 4B.

In particular, the thrust wing 12 is projectingly extended from the corresponding lateral face 4A, 4B beyond the lateral edge of the shaped plate of the peripheral surface 4C of the disc 4.

According to the invention, the thrust wing 12 is provided with a front face 13, which is oriented in accordance with the rotation sense R of the disc 4 when the latter is actuated to rotate by the drive system 5, in a manner such to intercept the component of the solid material which penetrates into the corresponding lateral interspace I.

More in detail, the front face 13 of the thrust wing 12 is extended between an internal part 14, preferably front, and an external part 15, preferably rear, which is further away from the rotation axis Y of the disc 4 with respect to the internal part 14.

Suitably, the thrust wing 12, and in particular its front face 13, is at least partially extended (and preferably completely extended) within the corresponding lateral face 4A, 4B within the external edge 4D of the lateral face 4A, 4B itself. In this manner, the thrust wing 12, and in particular its front face 13, is extended in the lateral interspace I delimited between the corresponding disc 4 and the adjacent disc 4.

Such shape of the front face 13 of the thrust wing 12 allows the front face 13, following the rotation of the disc 4, to intercept the component of the solid material penetrated into the lateral interspace I, conveying it towards the external part 15 of the front face 13 itself, in this manner pushing the component of solid material away from the rotation axis Y of the disc 4, hence making it exit from the lateral interspace I between the discs 4.

Suitably, the thrust wings 12, extended within the corresponding lateral faces 4A, 4B of the discs 4, and hence being permanently inserted within the lateral interspaces I between the discs 4, are capable—following the rotation of the latter—of also intercepting the solid material that has already possibly penetrated within the lateral interspaces I themselves, expelling it from the latter.

In particular, the internal part 14 of the thrust wing 12 is placed at a first zone of the corresponding lateral face 4A, 4B of the disc 4 radially closer to the rotation axis Y, while the external part 15 of the thrust wing 12 is placed at a second zone of the corresponding lateral face 4A, 4B placed radially further away from the rotation axis Y and preferably at the external section of the disc 4.

Advantageously, the front face 13 of the thrust wing 12 has a longitudinal section which is extended, in the aforesaid rotation sense R, from the external part 15 to the internal part 14 in moving closer to the rotation axis Y. In particular, the aforesaid longitudinal section is defined by the interception of the front face 13 with a surface orthogonal to the rotation axis Y of the disc 4. Suitably, such longitudinal section of the front face 13 of the thrust wing 12 is extended for a specific circular sector around the rotation axis Y of the disc 4 and, preferably, is substantially parallel to the corresponding lateral face 4A, 4B of the disc 4 itself. The longitudinal section of the front face 13 of the thrust wing 12 is extended within the corresponding lateral face 4A, 4B of the disc 4. More in detail, the aforesaid longitudinal section is positioned, at least partially, within the external edge 4D of the corresponding lateral face 4A, 4B. In particular, such longitudinal section is placed entirely within the external edge 4D of the corresponding lateral face 4A, 4B, with possibly at most the external part 15 of the thrust wing 12 placed at such external edge 4D, e.g. substantially flush with the latter.

Preferably, the thrust wing 12, and in particular the longitudinal section of its front face 13, does not project outside the external edge 4D of the corresponding lateral face 4A, 4B.

In operation, when the disc 4 is rotated in the rotation sense R, the internal part 14 of the front face 13 of the thrust wing 12 precedes the external part 15. In this manner the solid material is intercepted by the internal part 14 of the thrust wing 12 and pushed outside the lateral interspace I and in the advancing sense due to the particular extension of the longitudinal section of the front face 13.

Advantageously, the centrifugal vortex generated by the thrust wings 12 of the rotating discs 4 further facilitates to maintain the light material outside the lateral interspaces I between the discs 4.

Advantageously, the longitudinal section of the front face 13 has convex shape and, preferably, curved shape. Such particular shape of the longitudinal section of the front face 13 further facilitates the thrust action of the front face 13 on the residue material component, conveying it towards its external part 15 and hence outside the lateral interspace I, without such material remaining blocked on the front face 13 itself.

Figure 14:
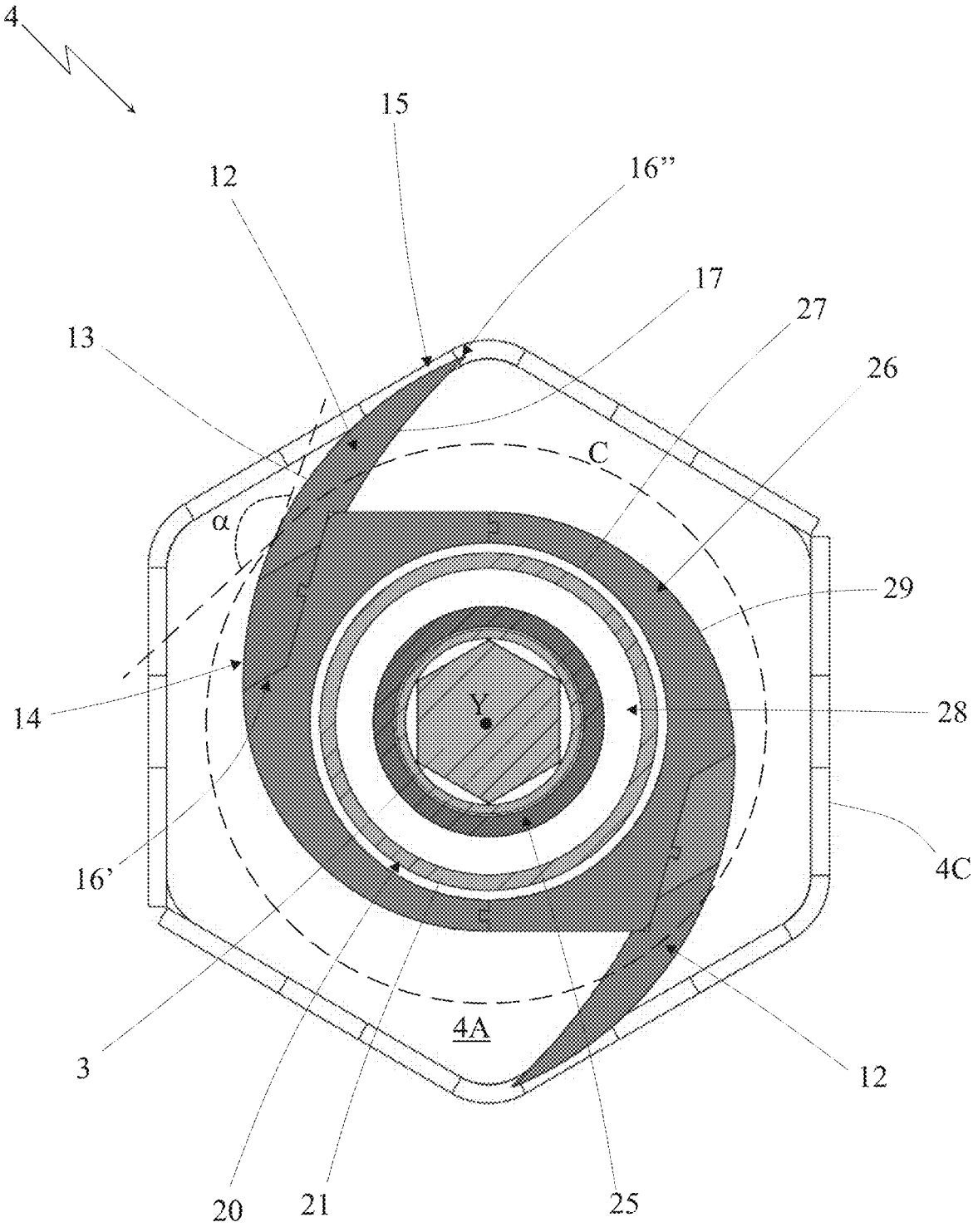
FIG. 14 shows a side view of one of the discs of FIG. 12.
Figure 15:
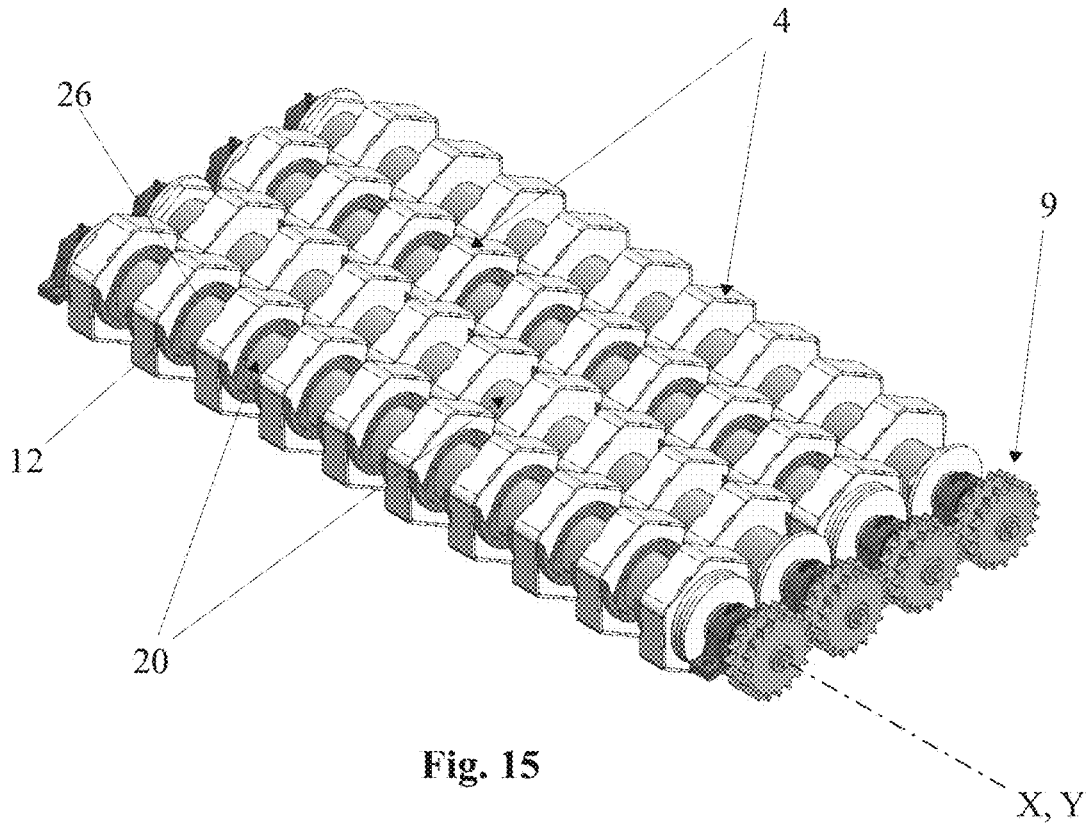
FIG. 15 shows a perspective view of the present disc screen, relative to several rotation shafts, in accordance with a fourth embodiment of the present invention.

Preferably, with reference to the examples of FIGS. 5 and 14, the longitudinal section of the front face 13 of the thrust wing 12 delimits, point by point, a tilt angle $\alpha$ greater than 90° (and preferably obtuse) with a circumference C having center in the rotation axis Y of the disc 4 and passing through such point of the longitudinal section.

In particular, the aforesaid angle $\alpha$ is extended from the circumference tangent line C at the point of incidence with the longitudinal section towards the external part 15 of the front face 13, up to the line tangent to the longitudinal section at the aforesaid incidence point.

Such tilt angle $\alpha$ of the longitudinal section allows the thrust wing 12, during the rotation of the disc 4 in the rotation sense R, to move the material component—penetrated into the lateral interspace I between the discs 4—outside the lateral interspace I and, simultaneously, make it advance in the advancing sense along the advancing direction A.

Preferably, the thrust wing 12 is provided with a rear face 17, for example with concave shape, which is directed in the opposite sense with respect to the front face 13.

In particular, the front face 13 of the thrust wing 12, when the disc 4 rotates in the rotation sense R, precedes the rear face 17.

Suitably, the front face 13 and the rear face 17 delimit between them the thickness S of the thrust wing 12.

Advantageously, the thrust wing 12 is also provided with an internal side 18, which is directed towards the corresponding lateral face 4A, 4B of the disc 4 and is fixed to such lateral face 4A, 4B, and with an external side 19, which is directed in the opposite sense with respect to the internal side 18 and faces the lateral interspace I between the discs 4. Suitably, the internal side 18 and the external side 19 delimit between them the width H of the thrust wing 12 (along the rotation axis Y of the disc 4), and such width H, in particular, defines the distance with which the thrust wing 12 protrudes projectingly from the corresponding lateral face 4A, 4B of the disc 4.

Advantageously, the front face 13 of the thrust wing 12 is substantially orthogonal to the corresponding lateral face 4A, 4B of the disc 4, in a manner such that, preferably, the thrust wing 12 is projecting from the corresponding lateral face 4A, 4B of the disc 4 perpendicular to the aforesaid lateral face 4A, 4B for the above-defined width H.

Advantageously, the thrust wing 12 is extended with elongated shape from the internal part 14 to the external part 15 of the front face 13, in particular with curved shape.

Preferably, the thrust wing 12 is extended longitudinally between a front end 16' (placed at the internal part 14 of the front face 13), which is directed to the front with respect to the rotation sense R of the disc 4, and an opposite rear end 16" (placed at the external part 15 of the front face 13).

Preferably, at least part of the front face 13 of the thrust wing 12 is placed spaced from the external edge 4D of the lateral face 4A, 4B within such external edge 4D. In particular, the internal part 14 of the front face 13 of the thrust wing 12 is placed, on the corresponding lateral face 4A, 4B, spaced from the external edge 4D of the corresponding lateral face 4A, 4B.

Suitably, the thrust wing 12 has rigid shape and is made for example of metallic material, plastic material, PVC or another material.

In particular, the thrust wing 12 is fixed to the corresponding lateral face 4A, 4B of the disc 4, e.g. by means of welding or screw arrangements, or it can be made in a single body with the corresponding lateral face 4A, 4B of the disc 4, for example by means of molding.

In accordance with the embodiments illustrated in the enclosed figures, the thrust wing 12 is made in a single body. Otherwise, the thrust wing 12 can be made of multiple separate parts connected to each other and/or fixed to the corresponding lateral face 4A, 4B of the disc 4, continuously with respect to each other.

In accordance with the exemplifying embodiments illustrated in FIGS. 4-9, the longitudinal extension of the thrust wing 12 terminates at its free front end 16'. In particular, the thrust wing 12 has the thickness S (defined between the front face 13 and the rear face 17) which is tapered towards the internal part 14 of the front face 13, i.e. towards the front end 16' of the thrust wing 12.

Advantageously, the front end 16' of the thrust wing 12 has pointed shape and is directed to the front with respect to the rotation sense R of the disc 4.

In operation, the front end 16', pointed, being placed at the internal part 14 of the front face 13, first intercepts the residue material component that has penetrated into the lateral interspace I, facilitating the penetration of the thrust wing between the residue materials in order to more easily remove them.

Advantageously, the rear face 17 of the thrust wing 12 is joined to the front face 13 at the front end 16', in a manner such that, at the latter, the thickness S of the thrust wing 12 is tapered towards the internal part 14 of the front face 13.

Figure 6:
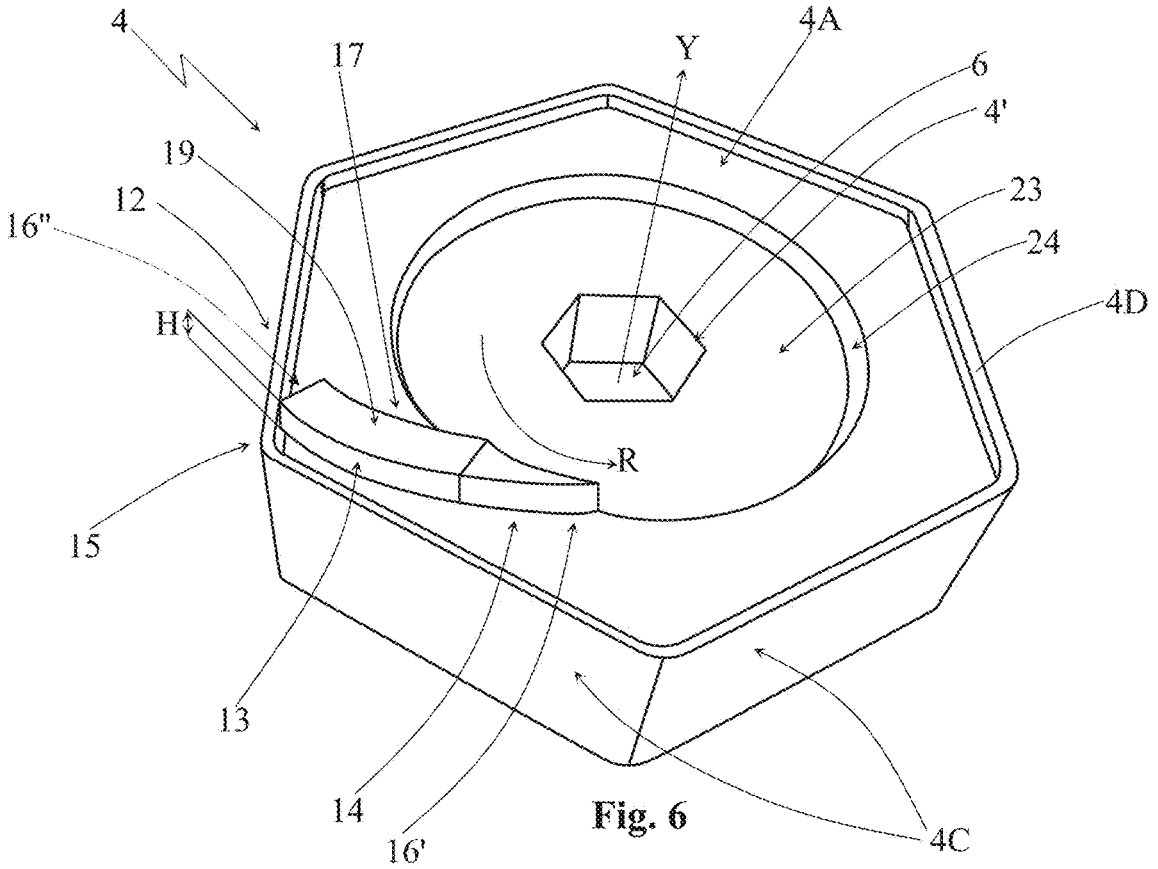
FIG. 6 shows a perspective view of the disc of FIG. 5.
Figure 7:
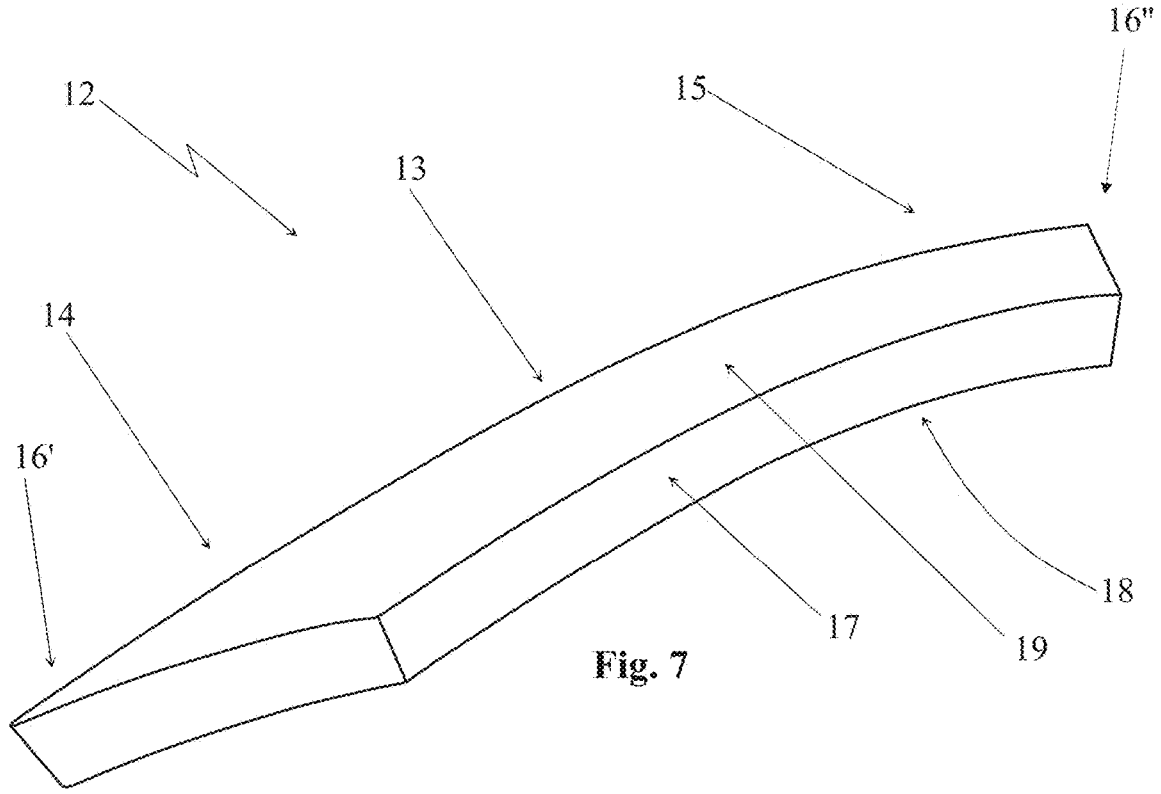
FIG. 7 shows a perspective view of a detail of the disc illustrated in FIG. 6, relative to a thrust wing of the disc itself.

In accordance with a first embodiment of the present invention illustrated in the FIGS. 6 and 7, the thrust wing 12 is extended from the internal part 14 to the external part 15 with width H (defined between the internal side 18 and the external side 19) substantially constant.

In particular, according to such first embodiment, the pointed front end 16' of the thrust wing 12 has a cutter of linear shape, preferably rectilinear and in particular parallel to the rotation axis Y of the disc 4.

Figure 8:
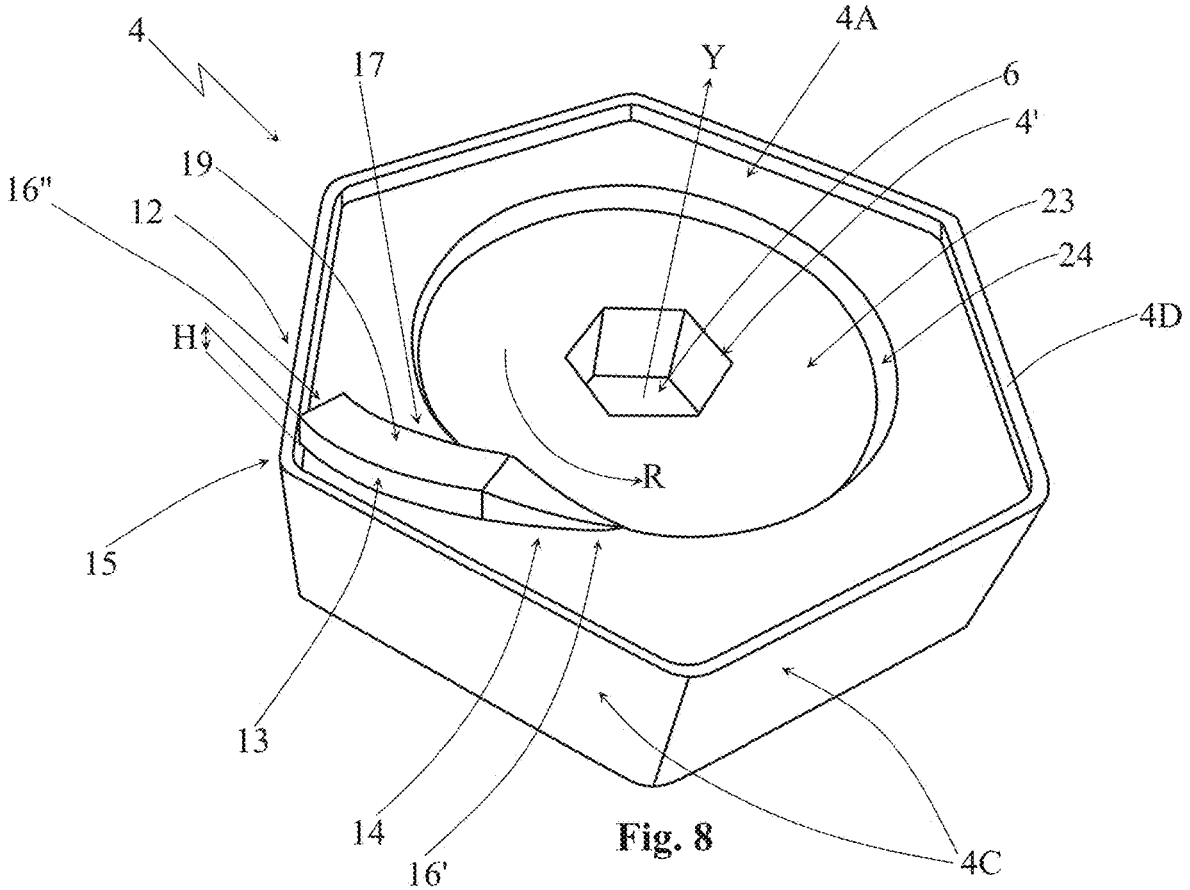
FIG. 8 shows a perspective view of one of the discs of the present screen, in accordance with a second embodiment of the present invention.
Figure 9:
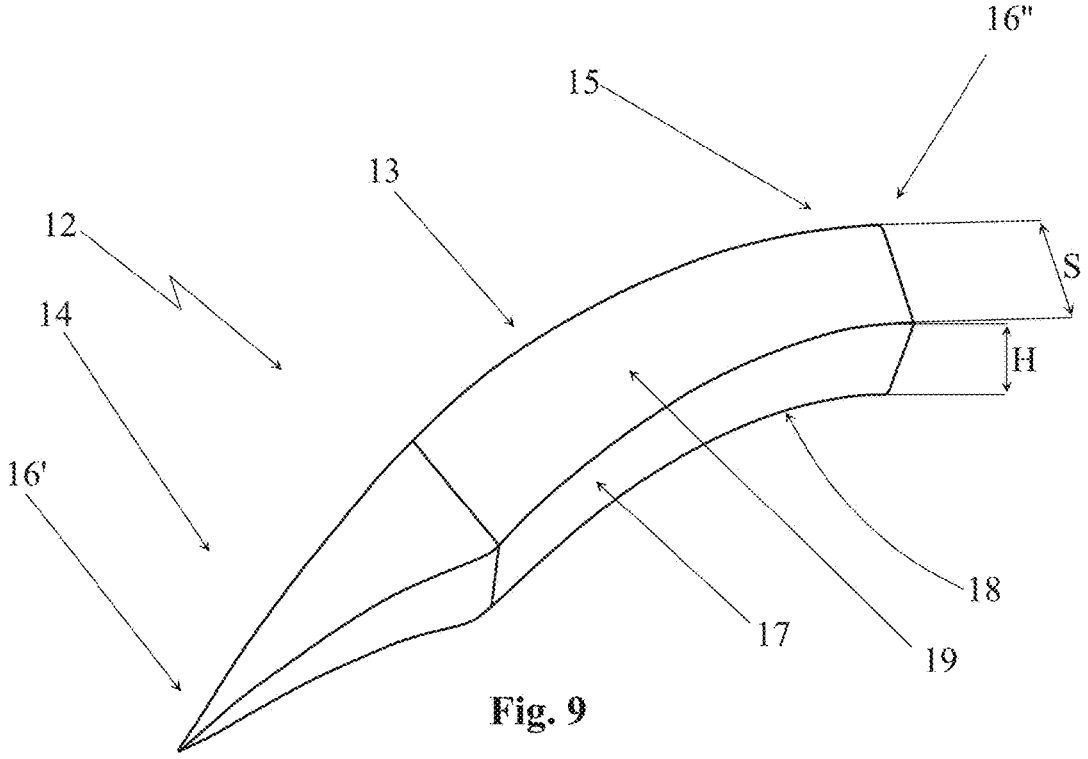
FIG. 9 shows a perspective view of the interception element of the disc illustrated in FIG. 8.
Figure 10:
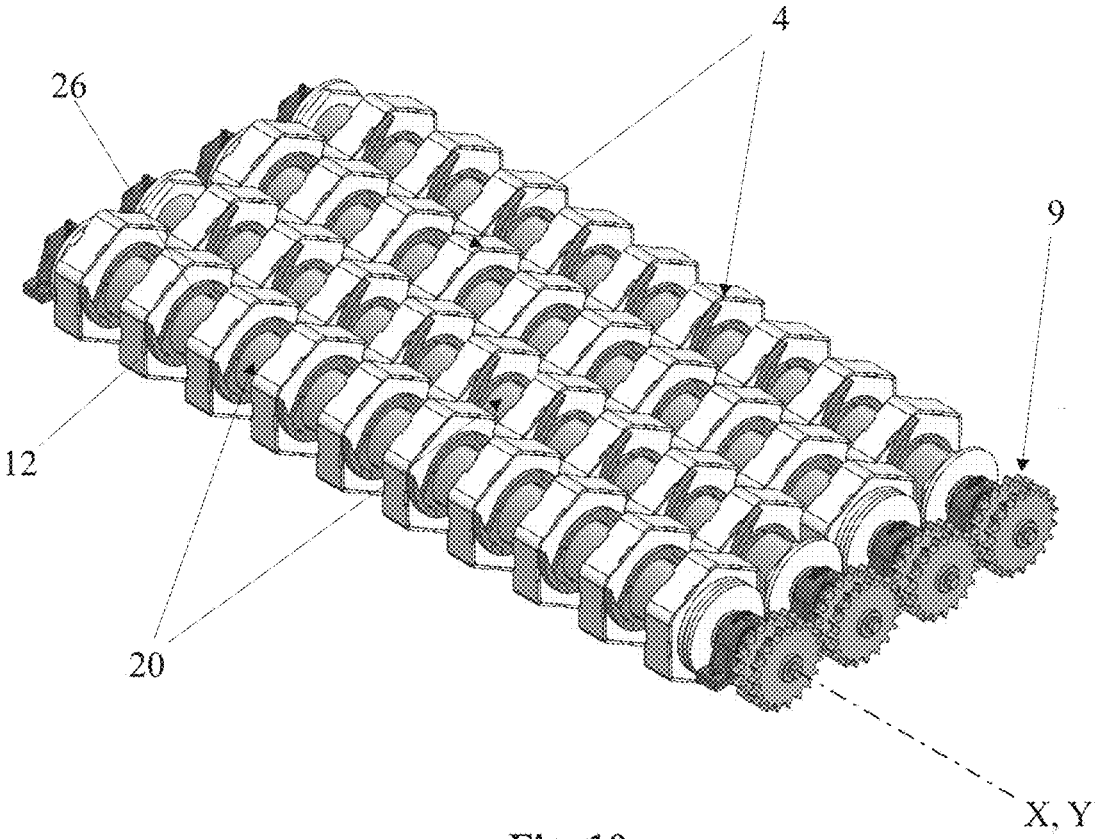
FIG. 10 shows a perspective view of the present disc screen, relative to several rotation shafts, in accordance with a third embodiment of the present invention.

In accordance with a second embodiment of the present invention illustrated in the FIGS. 8 and 9, the thrust wing 12 has width H tapered towards the internal part 14 of the front face 13, in particular at the front end 16'.

More in detail, the external side 19 of the thrust wing 12 is joined to the internal side 18 at the front end 16', in a manner such that, at such front end 16', the thrust wing 12 has width H tapered towards the internal part 14 of the front face 13.

In particular, according to such second embodiment, the front end 16' of the thrust wing 12 has a cutter of point-like shape.

Figure 4:
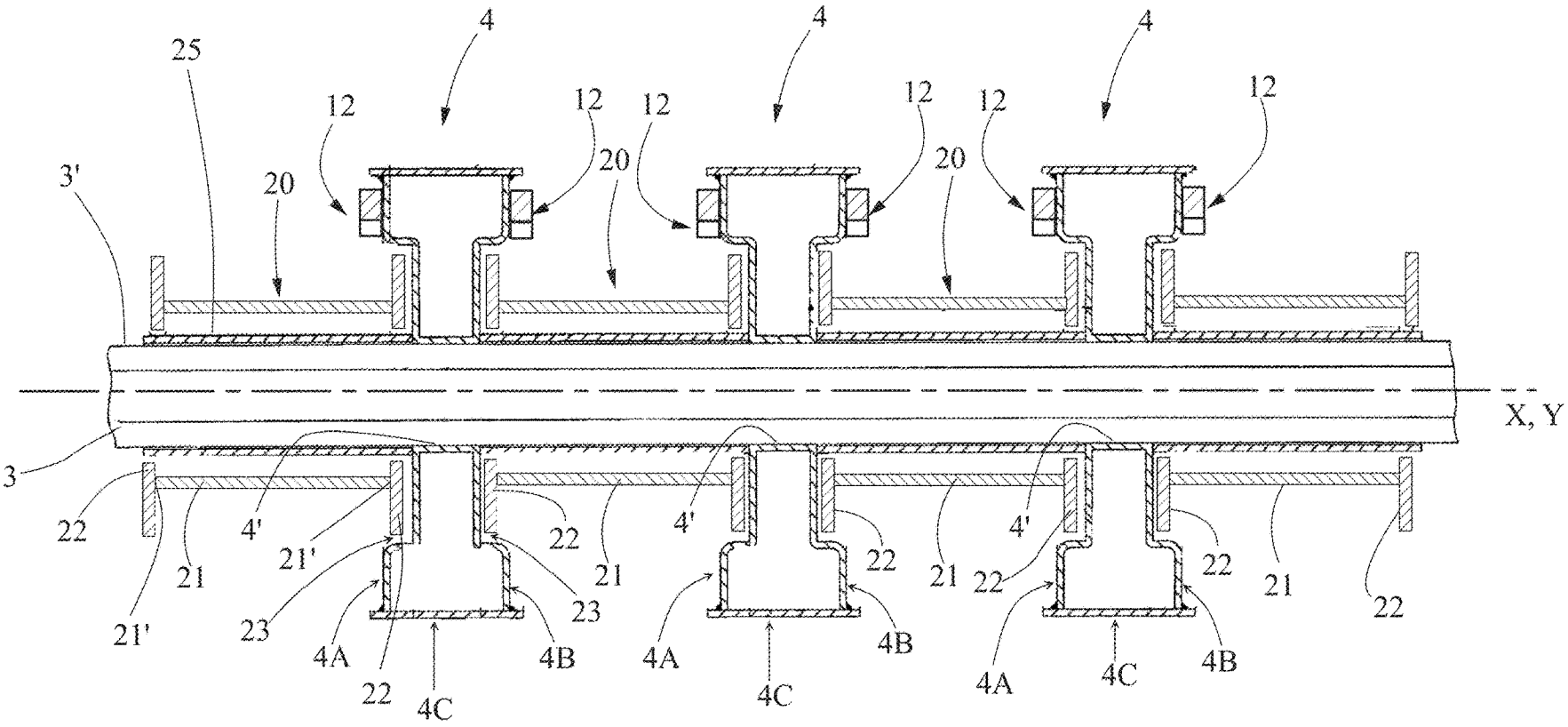
FIG. 4 shows a view in longitudinal section of one of the rotation shafts of the present disc screen, in accordance with a first embodiment of the present invention.

In accordance with the embodiment illustrated in FIG. 4, each idle sleeve 20 of the disc screens is provided with two annular flanges 22, each of which fixed to the corresponding end edge 21' of the tubular body 21 of the sleeve 20 itself and facing the corresponding lateral faces 4A, 4B of the discs 4.

Preferably, each lateral face 4A, 4B of the disc 4 has a central depression 23 of circular shape (coaxial with the rotation axis Y) within which the corresponding annular flange 22 of the sleeve 20 is advantageously inserted, substantially to size, with a minimum clearance that allows the rotation of the annular flange 22 in the corresponding central depression 23. In particular, the central depression 23 is surrounded by an annular shoulder 24 substantially orthogonal to the lateral face 4A,4B of the disc 4, extended around the external edge of the corresponding annular flange 22.

Advantageously, the internal part 14 of the front face 13 of each thrust wing 12, and preferably the front end 16' of the latter, are placed at the sleeve 20, in particular in proximity to the latter.

With reference to the embodiment illustrated in FIG. 4, the internal part 14 of the front face 13 of each thrust wing 12 is placed at the annular flange 22 of the sleeve 20, and preferably in proximity to the annular shoulder 24 of the central depression 23 of the corresponding lateral face 4A, 4B of the disc 4.

Of course, the thrust wings 12 according to the aforesaid first and second embodiment can also be prearranged in disc screens 1 in which the sleeves 20 lack annular flanges 22 and/or the lateral faces 4A, 4B of the discs 4 lack central depressions 23. For example, in an embodiment variant in which the sleeves 20 lack annular flanges 22, the internal part 14 of the front face 13 of each thrust wing 12 is placed at the tubular body 21 of the sleeve 20, and in particular in proximity to the end edge 21' of the tubular body 21 itself.

In accordance with a further embodiment variant, the disc screen 1 is not provided with the aforesaid sleeves 20 and the front end 16' of the thrust wing 12 is positioned at the corresponding rotation shaft 3 or at the spacer tubular body 25.

Advantageously, according to the invention, the external part 15 of the front face 13 of the thrust wing 12 is positioned at the external edge 4D of the corresponding lateral face 4A,4B, in a manner such to facilitate the expelling of the residue material outside the lateral interspace I between the discs 4.

Advantageously, the external part 15 of the front face 13 of the thrust wing 12 is substantially tangent to the external edge 4D of the lateral face 4A, 4B, in particular so as to avoid forming cavities in which the material to be screened could be accumulated.

Advantageously, in accordance with the embodiments illustrated in FIGS. 10-18, the discs 4 comprise at least one central ring 26, which is fixed to at least one of the two lateral faces 4A, 4B of the discs 4 themselves.

Such central ring 26 is projectingly extended from the corresponding lateral face 4A, 4B and is placed around the corresponding rotation shaft 3 (on which the corresponding disc 4 is mounted).

In particular, each central ring 26 is provided with an internal section 27, preferably with circular shape, which defines a through opening 28 crossed by the rotation shaft 3, and an external section 29 which defines, with the internal section 27, the thickness of the central ring 26.

Suitably, the central ring 26 is made of rigid material (such as metal, plastic material, PVC or other material) and is fixed to the lateral face 4A, 4B of the disc 4 for example by means of welding or screw arrangements (or even made in a single body with the lateral face 4*a*, 4B).

Advantageously, the end edge 21' of the tubular body 21 of the idle sleeves 20 is inserted within the through opening 28 of the central ring 26 fixed to the corresponding lateral face 4A, 4B of the corresponding disc 4.

In particular, the end edge 21' of the sleeve 20 is inserted in the through opening 28 of the central ring 26 substantially to size with the internal section 27 of the latter, with a specific clearance (e.g. 2-3 mm) between internal section 27 of the central ring 26 and end edge 21' of the sleeve 20 which allows the idle rotation of the latter.

Such arranging of the end edge 21' of the sleeve 20 in the central ring 26 allows protecting the zones where the material (e.g. granular or filiform) could be inserted between sleeve 20 and disc 4, giving rise to an undesired connection of these two elements which would obstruct the idle rotation of the sleeve 20 with respect to the rotation shaft 3.

Advantageously, the central ring 26 is connected to the thrust wing 12 at least at the front end 16' of the thrust wing 12 itself.

Preferably, the internal part 14 of the front face 13 of the thrust wing 12 is connected to the external section 29 of the central ring 26, in particular continuously with respect to each other (e.g. without interruption), suitably without the formation of corners or troughs in which the material can be accumulated.

Preferably, the external section 29 of the central ring 26 is extended, from the point at which it is in contact with the front end 16' of the thrust wing 12, as a continuation of the internal part 14 of the front face 13 of the latter, in particular with curved shape.

In operation, the configuration of the thrust wing 12 connected to the central ring 26 allows such elements to act synergistically in order to prevent the material that entered into the lateral interspaces I between the discs 4 from penetrating deeply in the interspace I, hence preventing such material from affecting the rotation shafts 3 (and advantageously the sleeves 20) and facilitating the expelling thereof.

Advantageously, the central ring 26 has width H' smaller than the width H of the thrust wing 12, so as to not considerably vary the lateral interspace I between the discs 4 and hence the screening section of the disc screen 1.

More in detail, the central ring 26 is projectingly extended from the corresponding lateral face 4A, 4B of the disc 4 with a width H' (according to a direction parallel to the extension axis X), smaller than the width H with which the thrust wing 12 is projectingly extended from the corresponding lateral face 4A, 4B.

In accordance with the examples illustrated in FIGS. 10-18, two thrust wings 12 are provided that are advantageously connected to the corresponding central rings 26. Of course, without departing from the protective scope of the present patent, also only one thrust wing 12 or more than two thrust wings 12 (e.g. three or six) could be provided, associated with the corresponding central ring 26.

Advantageously, the central ring 26 is made of multiple parts (e.g. two) that are separate from each other, preferably connected and joined to each other. Such arrangement in particular allows being able to mount the central rings 26 without having to remove the discs 4 from the rotation shaft 3, rendering particularly simple and quick the operations of substitution of the central rings 26 or their mounting on pre-existing screens.

Advantageously, the external section 29 of the central ring 26 is provided with a positioning seat (e.g. concave) in which at least the front end 16' of the thrust wing 12 is placed. Such positioning seat has section counter-shaped with respect to a section of the rear face 17 of the thrust wing 12 placed in such seat, so as to easily identify the correct position of the thrust wing 12 with respect to the central ring 26.

In particular, the arrangement of the thrust wings 12 connected to the central ring 26 allows simply and quickly determining, in assembly step, the correct position of the thrust wing 12 on the lateral face 4A, 4B of the disc 4, since the radial distance of the thrust wing 12 from the rotation shaft 3 is determined by the central ring 26, while the angular position of the thrust wing 12 around the rotation shaft 3 can be easily identified for example by placing the rear end 16' of the thrust wing 12 at one of the vertices of the external edge 4D of the disc 4. Suitably, with reference to the example of FIGS. 11 and 16, the lateral interspace I between the discs 4 is delimited by a lateral face 4A with thrust wing 12 (and advantageously central ring 26) of a disc 4 and a lateral face 4B lacking such elements of a disc 4 mounted on the successive rotation shaft 3. Such arrangement, in particular, limits the variation of the screening section of the disc screen 1.

In accordance with a third embodiment of the present invention, illustrated in the FIGS. 10-13, the thrust wings 12, and advantageously the central rings 26, are placed on only one of the lateral faces 4A, 4B of the discs 4 (in particular on all the discs 4), in a manner such that the thrust wings 12 are placed on the faces 4A of the discs 4 directed in the same sense. Suitably, as is visible for example in the view of FIG. 12, the thrust wings 12 of the discs 4 of a rotation shaft 12 are placed angularly offset (e.g. by 180°) with respect to the thrust wings 12 of the discs 4 of the successive rotation shaft 3.

In accordance with a fourth embodiment of the present invention, illustrated in the FIGS. 15-18, the thrust wings 12, and advantageously the central rings 26, are arranged on a subset of discs 4. In particular, rotation shafts 3 are provided with discs 4 provided with thrust wings 12 alternated with rotation shafts 3 with discs 4 without thrust wings 12. In particular, the discs 4 with thrust wings 12 (and advantageously central ring 26) are provided with such elements on both lateral faces 4A, 4B thereof.

In operation, during such advancing of the solid material on the screening surface, the residues with sizing smaller than the openings defined between the discs 4 of each rotation shaft 3 and the sleeves 20 of the successive rotation shaft 3 fall via gravity below the screening surface, obtaining the selection of the materials as a function of their size.

During the screening, the presence of the sleeves 20 prevents, or at least limits, the winding of filiform residues around rotation shafts 3.

The thrust wings 12 of the discs 4, according to the present invention, allow expelling—outside the lateral interspaces I between discs 4—undesired interposed material (such as filamentous plastic material) which could lead to connect the sleeves 20 to the discs 4 and to the rotating shaft 3, thus rotating also the sleeve 20 and leading to the twisting of the filiform material.

The disc screen for separating solid materials thus conceived therefore attains the pre-established objects.

The contents of the Italian patent application number 102019000013791, from which this application claims priority, are incorporated herein by reference.

The invention claimed is:

1. A disc screen for separating solid materials, the disc screen comprising:

a support structure;

a plurality of rotation shafts rotatably mounted on said support structure and positioned parallel to each other;

a plurality of discs fixed to said rotation shafts and positioned in succession, spaced one from the next, along the corresponding said rotation shaft; wherein each of said discs is provided with a rotation axis parallel to the corresponding said rotation shaft and is extended according to said rotation axis between two lateral faces directed in opposite senses; wherein each lateral face of each said disc is provided with an external edge extended around said rotation axis;

a drive system mechanically connected to said rotation shafts and configured for actuating said discs to rotate around said rotation axis in a rotation sense;

wherein said discs comprise at least one thrust wing, which is fixed to at least one of said two lateral faces and is projectingly extended from said lateral face;

wherein each said thrust wing is provided with a front face, which is oriented in accordance with said rotation sense and is extended between an internal part and an external part further away from said rotation axis with respect to said internal part;

wherein the front face of said thrust wing has a longitudinal section which:

is extended within the lateral face of said disc with at least said internal part positioned inside the external edge of said lateral face;

is extended according to said rotation sense from said external part to said internal part in moving closer to said rotation axis;

wherein said thrust wing is extended with elongated shape from the internal part to the external part of said front face;

wherein said thrust wing is extended longitudinally between a front end, which is placed at the internal part of said front face and is directed to front with respect to the rotation sense of said disc, and an opposite rear end, which is placed at the external part of said front face;

wherein the front end of said thrust wing is placed, on said lateral face, internally spaced from the external edge of said lateral face;

wherein the rear end of said thrust wing is placed on the external edge of said lateral face;

wherein said thrust wing is provided with a rear face, which is directed in opposite sense with respect to said front face and is positioned inside said lateral face, so that the front face of said thrust wing, when said disc rotates in said rotation sense, precedes said rear face.

2. The disc screen of claim 1, wherein the external edge of said lateral face has convex shape and the longitudinal section of the front face of said thrust wing is positioned inside said external edge.

3. The disc screen of claim 1, wherein the longitudinal section of said front face delimits, point by point, a tilt angle greater than 90° with a circumference having center at said rotation axis and passing through said point.

4. The disc screen of claim 1, wherein the longitudinal section of said front face has convex shape.

5. The disc screen of claim 1, wherein the longitudinal section of said front face has curved shape.

6. The disc screen of claim 1, wherein the internal part of said thrust wing is placed at a first zone of said lateral face radially closer to said rotation axis, and the external part of said thrust wing is placed at a second zone of said lateral face placed radially further away from said rotation axis with respect to said first zone.

7. The disc screen of claim 1, wherein said discs comprise at least one central ring, which is fixed to at least one of said two lateral faces, is extended projectingly from said lateral face, and is placed around the corresponding said rotation shaft.

8. The disc screen of claim 7, wherein said thrust wing is extended between a front end placed at the internal part of said front face, and a rear end placed at the external part of said front face; wherein said thrust wing is connected to said central ring at least at said front end.

9. The disc screen of claim 7, wherein the internal part of the front face of said thrust wing is connected, substantially without interruption, to an external section of said central ring.

10. The disc screen of claim 7, further comprising a plurality of sleeves, each of which is mounted externally idle on the corresponding said rotation shaft between two successive discs, and comprises a tubular body extending parallel to said rotation axis between two opposite end edges positioned at the corresponding lateral faces of said subsequent discs; wherein said central ring is provided with an internal section, which defines a through opening in which the corresponding end edge of the tubular body of said sleeve is inserted, with clearance with respect to said internal section.

11. The disc screen of claim 7, wherein said central ring is extended projectingly from the corresponding said lateral face of said disc with a width, according to a direction parallel to said rotation axis, smaller than the width with which said thrust wing is extended projectingly from the corresponding said lateral face.

12. A disc screen for separating solid materials, the disc screen comprising:

a support structure;

a plurality of rotation shafts rotatably mounted on said support structure and positioned parallel to each other;

a plurality of discs fixed to said rotation shafts and positioned in succession, spaced one from the next, along the corresponding said rotation shaft; wherein each of said discs is provided with a rotation axis parallel to the corresponding said rotation shaft and is extended according to said rotation axis between two lateral faces directed in opposite senses; wherein each lateral face of each said disc is provided with an external edge extended around said rotation axis;

a drive system mechanically connected to said rotation shafts and configured for actuating said discs to rotate around said rotation axis in a rotation sense;

wherein said discs comprise at least one thrust wing, which is fixed to at least one of said two lateral faces and is projectingly extended from said lateral face;

wherein each said thrust wing is provided with a front face, which is oriented in accordance with said rotation sense and is extended between an internal part and an external part further away from said rotation axis with respect to said internal part;

wherein the front face of said thrust wing has a longitudinal section which:

is extended within the lateral face of said disc with at least said internal part positioned inside the external edge of said lateral face;

is extended according to said rotation sense from said external part to said internal part in moving closer to said rotation axis;

wherein said discs comprise at least one central ring, which is fixed to at least one of said two lateral faces, is extended projectingly from said lateral face, and is placed around the corresponding said rotation shaft;

wherein said thrust wing is extended between a front end placed at the internal part of said front face, and a rear end placed at the external part of said front face; wherein said thrust wing is connected to said central ring at least at said front end;

the disc screen further comprising a plurality of sleeves, each of which is mounted externally idle on the corresponding said rotation shaft between two successive discs, and comprises a tubular body extending parallel to said rotation axis between two opposite end edges positioned at the corresponding lateral faces of said subsequent discs; wherein said central ring is provided with an internal section, which defines a through opening in which the corresponding end edge of the tubular body of said sleeve is inserted, with clearance with respect to said internal section.

* * * * *